United States Patent [19]

Sakulevich et al.

[11] 4,170,849

[45] Oct. 16, 1979

[54] ROTARY MACHINE FOR THREE-DIMENSIONAL POLISHING OF WORKPIECES SHAPED AS SOLIDS OF REVOLUTION IN A MAGNETIC FIELD USING FERROMAGNETIC ABRASIVE POWDERS

[76] Inventors: Faddei J. Sakulevich, pereulok Dalny, 3; Alexandr A. Kosobutsky, ulitsa R. Ljuxemburg, 171, kv. 5, both of Minsk, U.S.S.R.

[21] Appl. No.: 895,475

[22] Filed: Apr. 11, 1978

[30] Foreign Application Priority Data

Jul. 26, 1977 [SU] U.S.S.R. ..... 2513229

[51] Int. Cl.[2] ..... B24B 31/00

[52] U.S. Cl. ..... 51/7; 51/156

[58] Field of Search ..... 51/7, 17, 26, 163.1, 51/163.2, 150, 156

[56] References Cited

FOREIGN PATENT DOCUMENTS 403537 4/1974 U.S.S.R. ..... 51/7

564950 7/1977 U.S.S.R. ..... 51/7

*Primary Examiner*—Harold D. Whitehead

*Attorney, Agent, or Firm*—Fleit & Jacobson

[57] ABSTRACT

The rotary machine for three-dimensional polishing of workpieces shaped as solids of revolution in a magnetic field using ferromagnetic abrasive powders comprises an electromagnetic system incorporating an annular working air gap adapted for the ferromagnetic abrasive powder to accommodate therein, and a rotor arranged oppositely to the electromagnetic system and carrying spindles for the workpieces being machined to hold, said spindles being spaced peripherally on the rotor so as to traverse the workpieces along the working gap of the electromagnetic system when the rotor is running. The electromagnetic system comprises a number of segments having different magnetic induction which gradually diminishes along the direction of traverse of the workpieces being machined. The space of the air gap within each of the segments is filled with the ferromagnetic abrasive powder of different fineness ratio which is gradually diminished along the direction of traverse of the workpieces being machined.

2 Claims, 4 Drawing Figures

ROTARY MACHINE FOR THREE-DIMENSIONAL POLISHING OF WORKPIECES SHAPED AS SOLIDS OF REVOLUTION IN A MAGNETIC FIELD USING FERROMAGNETIC ABRASIVE POWDERS

The present invention relates to the sphere of abrasive treatment of workpieces in a magnetic field and has particular reference to rotary machines for three-dimensional polishing workpieces shaped as solids of revolution in a magnetic field using ferromagnetic abrasive powders. The invention can find most utility when employed for polishing intricately shaped workpieces immediately after their machining in a lathe.

One prior-art rotary machine for three-dimensional polishing of workpieces shaped as solids of revolution in a magnetic field using ferromagnetic abrasive powders is known to comprise an electromagnetic system made up by the pairs of magnets facing each other with the pole-pieces thereof, between which an air gap is provided for the ferromagnetic abrasive powder to accommodate, the pairs of magnets being so arranged that the air gap is annular-shaped. Arranged oppositely to the electromagnetic system is the rotor carrying spindles spaced peripherally thereon and holding the workpieces being machined, which workpieces are capable of traversing along the working gap of the electromagnetic system when the rotor is running. The rotor has a rotational drive of its own, while the spindles have drives for imparting rotation and oscillating motion thereto.

Ferromagnetic abrasive powder is placed in the working gap of the electromagnetic system, the latter is energized, whereupon the ferromagnetic abrasive powder forms a magnetoabrasive brush. The workpiece being machined is traversed along the working gap, at the same time rotating round its own axis and performing oscillating motion. Thus, the workpiece being machined is embraced with the magnetoabrasive brush along the entire surface being machined, and said surface is polished.

An optimum degree of fineness of the ferromagnetic powder used for polishing the workpiece surface must correspond to a definite amount of roughness of the surface being machined. In addition, each amount of surface roughness is to correspond to its optimum magnitude of cutting force developed by the magnetoabrasive brush.

In the known rotary machine discussed above the working gap is filled with the ferromagnetic abrasive powder of the same fineness ratio, which gives machining effect to the surface being polished with a constant force, while the degree of roughness of the surface being machined changes as the workpiece is being traversed along the working gap. It is because of the above fact that the roughness of the surface being machined is reduced at a low rate at the initial period of machining when the degree of roughness is maximum, whereupon the machining occurs for some time under optimum conditions as the degree of roughness is being reduced; at last the ferromagnetic abrasive powder contained in the working gap practically reduces no longer the degree of roughness of the workpiece being machined. Thus, application of a ferromagnetic abrasive powder having the same fineness ratio fails to effect polishing of workpieces obtained after turning operations, on the known rotor machine so as to produce high-quality polished workpiece surface, nor allows it to attain high quality of surface finish, as well as hampers any increase in the efficiency of the process of magnetoabrasive polishing.

It is therefore an essential object of the present invention to obtain a polished surface of workpieces immediately after their machining in a lathe by virtue of machining said workpieces in a rotary machine for three-dimensional polishing with ferromagnetic abrasive powders in a magnetic field.

It is another object of the present invention to enhance the quality of polishing of the surface being machined.

It is one more object of the present invention to increase the efficiency of the magnetoabrasive polishing.

The essence of the present invention resides in that in a rotary machine for three-dimensional polishing of workpieces shaped as solids of revolution in a magnetic field using ferromagnetic abrasive powders, comprising an electromagnetic system which incorporates an annular working air gap adapted for the ferromagnetic abrasive powder to accommodate therein, a rotor arranged oppositely to the electromagnetic system and carrying spindles for the workpieces being machined to hold, said spindles being spaced peripherally on the rotor so as to traverse the workpieces along the working gap of the electromagnetic system when the rotor is running, drives to impart rotation and oscillating motion to the spindles, and a drive to impart rotation to the rotor, according to the invention the electromagnetic system comprises a number of segments having different magnetic induction which gradually diminishes along the direction of traverse of the workpieces being machined the space of the working gap within each of said segments being filled with the ferromagnetic abrasive powder of different fineness ratio which is gradually diminished along the direction of traverse of the workpiece being machined.

This makes it possible to provide optimum machining conditions in the working gap of each segment of the electromagnetic system for each degree of surface roughness of the workpiece being machined. Thus, the abrasive powder contained in the first segment as viewed along the direction of traverse of the workpiece being machined features a maximum fineness ratio, and a maximum value of magnetic induction is established in said segment which corresponds to a maximum degree of surface roughness of the workpiece obtained after its machining in a lathe. In the next segment both the fineness ratio of the abrasive powder and the value of magnetic induction are reduced which corresponds to a reduced roughness of the workpiece surface after its having been machined in the initial segment, and so on. The result of such a machining is high quality of polished workpiece surface. Thus, for example, the herein-proposed rotary machine is capable of efficiently polishing stomatological instruments featuring an initial surface roughness $R_z=20$ mcm resulting from lathe machining, to attain a roughness $R_z=16$ mcm, thus ruling out manual polishing operations that have earlier been indispensable for the purpose, as well as polishing with the use of a continuously fed abrasive belt. In addition, high quality of polished surface is attainable due to the fact that a ferromagnetic abrasive powder of minimum fineness ratio is made use of in the last segment of the electromagnetic system.

The herein-proposed rotary machine provides for high efficiency of the polishing process as each amount of surface roughness of the workpiece being machined corresponds to an optimum fineness ratio of the ferromagnetic abrasive powder and value of magnetic induction.

It is expedient that each of the segments be established by the inside and outside pole-pieces interconnected through magnetic cores whose outer arms carry magnet coils, while the inner arms thereof differ in cross-sectional area and are embraced with a common magnet coil, and every magnet coil is provided with an individual current regulator.

Provision of each segment with an individual magnetic core having an appropriate cross-sectional area of the arms thereof, is instrumental, through the agency of the current regulator of the common magnet coil embracing the inner arms of the magnetic cores, in establishing a required intensity of magnetization of the inside pole-pieces for each of the segments, respectively, whereas current regulators of the magnet coils located on the outer arms of the magnetic cores make it possible to establish a uniform field in each of the segments featuring the same magnetization intensity of the outside and inside pole-pieces which, in turn, develops identical cutting forces exerted by the particles of the ferromagnetic abrasive powder upon the surface of the workpiece being machined on the side of each of the pole-pieces when the workpiece is being passed along the working gap and prevents elastic workpieces from being attracted to either of the pole-pieces. In addition, the fact that every magnet coil is provided with an individual current regulator allows one to readily vary the value of magnetic induction effective in each of the segments.

Given below is a detailed description of a specific exemplary embodiment of the present invention provided by way of illustration with reference to the accompanying drawings, wherein.

Figure 1:
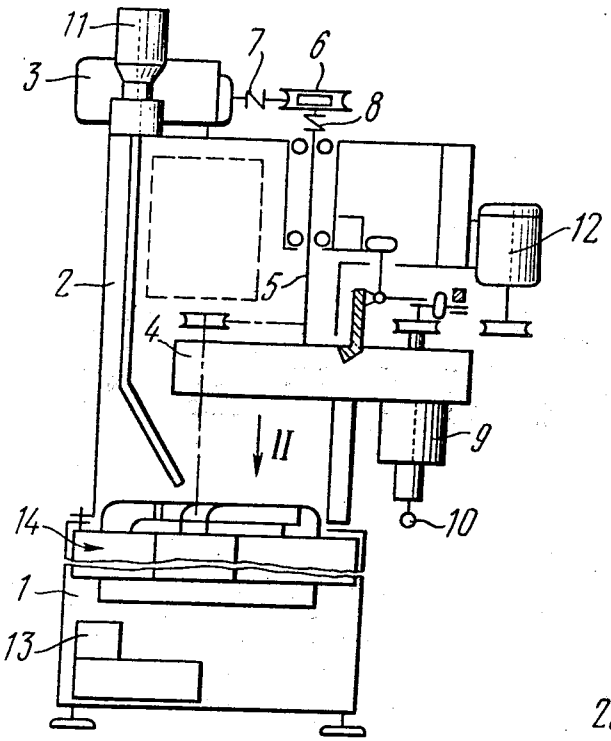
FIG. 1 is a schematic view of a rotary machine for three-dimensional polishing of workpieces shaped as solids of revolution in a magnetic field using ferromagnetic abrasive powders, according to the invention.

The rotary machine for three-dimensional polishing of workpieces shaped as solids of revolution in a magnetic field using ferromagnetic abrasive powders comprises a base 1 (FIG. 1) mounting a support 2 which carries also a drive 3 to impart rotation to a rotor 4. The rotor is set on a shaft 5 which is linked to the drive 3 through a worm speed reducer 6 and couplings 7, 8. Spaced peripherally on the rotor 4 are spindles 9 adapted to hold workpieces 10 shaped as solids of revolution. The support 2 mounts also a proportioning bin 11 for ferromagnetic abrasive powder and a drive 12 to impart rotary and oscillating motion to the spindles 9. The base 1 accommodates a magnetic separator for cleaning the cutting fluid and feeding it to the machining zone.

Built-in into the base 1 is an electromagnetic system 14 (FIGS. 1, 2) incorporating an annular magnetic air gap 15 (FIG. 2) adapted for the ferromagnetic abrasive powder to accommodate, said system being arranged oppositely to the rotor 4. The electromagnetic system 14 is composed of segments A,B,C having different magnetic induction which gradually diminishes as along the direction of working traverse of the workpieces 10 being machined. In the given specific embodiment of the invention represented in the appended drawings the workpieces 10 being machined are traversed clockwise, and the value of magnetic induction is maximum in the segment A of the electromagnetic system 14 and is minimum in the segment C.

Spaces **15*a*, 15*b*, 15*c* of the magnetic air gap 15 are filled with ferromagnetic abrasive powder of different fineness ratio which is gradually diminished in the direction of working traverse of the workpiece 10 being machined, i.e., the ferromagnetic abrasive powder contained in the space 15*a* of the magnetic air gap 15 features the maximum fineness ratio, while that in the space 15*c***, the minimum one.

Figure 2:
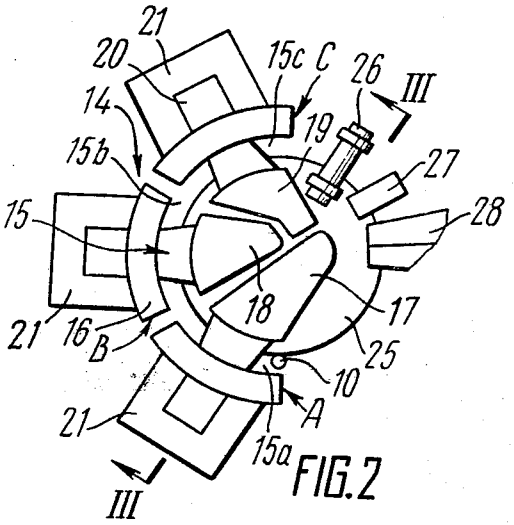
FIG. 2 is a scaled-up view taken along the arrow II in FIG. 1.
Figure 3:
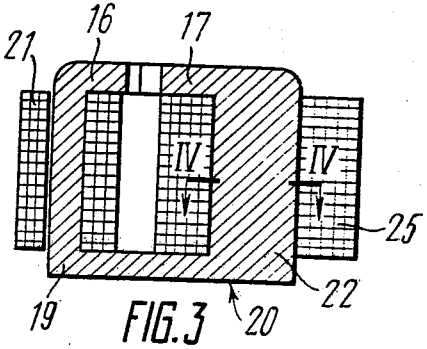
FIG. 3 is a section taken along the line III—III in FIG. 2 showing the electromagnetic system.
Figure 4:
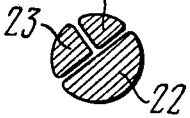
FIG. 4 is a section taken along the line IV—IV in FIG. 3.

Each of the segments A, B, C is formed by outside pole-pieces 16 and inside pole-pieces 17, 18, 19, respectively which interconnected through magnetic cores 20 (FIGS. 2,3). The outer arms of the magnetic cores 20 carry magnet coils 21, while inner arms 22, 23, 24 (FIG. 4) thereof feature different cross-sectional area to suit a preset value of magnetic induction and are embraced with a common coil 25 (FIGS. 2,3). Both of the magnet coils 21 and 25 are provided with individual current regulators of any conventional construction, said regulators being not shown in the drawings).

In order to effect automatic cycle of operation of the rotary machine it is provided with a demagnetizer 26 (FIG. 2) of the workpieces 10 being machined, a mechanism 27 for their cleaning and a handling arrangement 28 for loading and unloading the workpieces 10.

The rotary machine effected according to the present invention operates as follows.

Metered quantities of the ferromagnetic abrasive powder are fed from the proportioning bins 11 (FIG. 1) to the magnetic air gap 15 (FIG. 2) in such a manner that the abrasive powder of a preset fineness ratio is fed from the respective proportioning bin 11 (FIG. 1) to each of the spaces **15*a*, 15*b*, 15*c* which makes it possible to provide optimum conditions for machining the surface of the workpiece 10 in each of the spaces 15*a*, 15*b*, 15*c* (FIG. 2) of the magnetic air gap 15, said workpiece 10 having a definite degree of roughness of the surface thereof. Next the electromagnetic system 14 is energized to set up magnetic induction in the magnetic air gap 15 so that each of the spaces 15*a*, 15*b*, 15*c* the value of magnetic induction is preset depending upon the cross-sectional area of the inner arm 17, 18, 19 of the magnetic core 20 and the current magnitude effective in the respective outer coil 21, said current magnitude being set with the use of the current regulator (not shown) of said coil 21**.

The cross-sectional area of the inner arms 17, 18, 19 of the magnetic cores 20 and the current magnitude in the outer coils 21 are so selected that the value of magnetic induction in the magnetic air gap 15 build up a required cutting force exerted by the particles of the ferromagnetic abrasive powder upon the surface of the workpiece 10 being machined high enough to reduce the degree of roughness of the surface being machined within as short period of time as possible.

In addition, the aforesaid means are instrumental in maintaining equal magnetization intensity of the outside pole-pieces 16 and the inside pole-pieces 17, 18, 19 so as to prevent the workpiece 10 from being attracted to one of the pole-pieces.

Then there are turned in drives 12 (FIG. 1) to impart rotation and oscillating motion to the spindles 9, and the drive 3 to impart rotation to the rotor 4 and provide for a required speed of traversing of the workpieces 10 lengthwise the magnetic air gap 15 (FIG. 2). The workpieces 10 are fed from the handling arrangement 28 to the spindles 9 (FIG. 1) to be held in place thereto. While being moved along the magnetic air gap 15 (FIG. 2) the workpiece 10 rotates round its own axis and performs oscillating motion along with the spindle 9 (FIG. 1). At the same time the workpiece 10 is snugly encompassed, over the entire surface thereof, by a brush formed by the ferromagnetic abrasive powder in the magnetic air gap 15 (FIG. 2) upon energizing the electromagnetic system 14. While passing through the space 15*a*, wherein the fineness ratio of the abrasive powder and the value of magnetic induction are maximum, the workpiece 10 featuring maximum degree of roughness of the surface thereof, is subjected to machining under most rigorous conditions. Upon leaving the space 15*a* of the magnetic air gap 15 the workpiece 10 features a lesser degree of surface roughness so that when passing to the space 15*b* the workpiece 10 is machined under less rigorous conditions corresponding to the degree of roughness of the surface being machined. The value of magnetic induction effective in the space 15*c* is minimum, and the fineness ratio of the ferromagnetic abrasive powder contained therein is likewise minimum, which corresponds to the finish polishing conditions. Upon coming off from the space 15*c* of the magnetic air gap 15 the workpieces 10 are demagnetized in the demagnetizer 26, cleaned in the cleaning mechanism 27 and fed to the handling arrangement 28.

We claim:

1. A rotary machine for three-dimensional polishing of workpieces shaped as solids of revolution in a magnetic field using ferromagnetic abrasive powders, comprising: an electromagnetic system incorporating an annular working air gap adapted for the workpieces being machined to pass therealong, said electromagnetic system being established by a number of separate segments having different magnetic induction which is gradually diminished along the direction of traverse of the workpieces being machined; a ferromagnetic abrasive powder accommodated in said magnetic air gap in such a manner that the space of said magnetic air gap in each of said segments is filled with said ferromagnetic abrasive powder of different fineness ratio which is gradually diminished along the direction of traverse of the workpieces being machined; a rotor arranged oppositely to said electromagnetic system; spindles spaced peripherally on said rotor and adapted to hold the workpieces being machined so that with the rotor running, the workpieces being machined are made to traverse along said magnetic air gap of the electromagnetic system; a drive to impart rotation to said rotor; drives to impart rotation to said spindles round their own axes and oscillating motion thereto.

2. A rotary machine as claimed in claim 1, comprising: an outside pole-piece of each for said segments of the electromagnetic system; an inside pole-piece for each of said segments of the electromagnetic system; a magnetic core for each of said segments of the electromagnetic system adapted to interconnect said outside and said inside pole-pieces thereof; an outer arm for each of said magnetic cores; a magnet coil of each of said segments of the electromagnetic system, said coil being mountd on said outer arm of the magnetic core of that segment; an inner arm for each of said magnetic cores, the inner arms of the magnetic cores of said various segments having different cross-sectional area to suit a preset value of magnetic induction in the segments thereof; a common magnet coil embracing said inner arms of the magnetic cores of all of said segments of the electromagnetic system; current regulators for said magnet coils.

* * * * *